US009850923B2

(12) United States Patent
Lautzenhiser et al.

(10) Patent No.: US 9,850,923 B2
(45) Date of Patent: Dec. 26, 2017

(54) FLUID FLOW REGULATOR

(71) Applicant: Brookefield Hunter, Inc., Belgrade, MT (US)

(72) Inventors: Lloyd L. Lautzenhiser, Verdi, NV (US); Wade Wolf, Belgrade, MT (US)

(73) Assignee: Brookefield Hunter, Inc., Belgrade, MT (US)

( * ) Notice: Subject to any disclaimer, the term of this patent is extended or adjusted under 35 U.S.C. 154(b) by 437 days.

(21) Appl. No.: 14/600,791

(22) Filed: Jan. 20, 2015

(65) Prior Publication Data

US 2016/0208829 A1 Jul. 21, 2016

(51) Int. Cl.
*F15B 15/20* (2006.01)
*B66F 5/04* (2006.01)
*F15B 13/02* (2006.01)

(52) U.S. Cl.
CPC ..... *F15B 15/204* (2013.01); *B66F 5/04* (2013.01); *F15B 13/023* (2013.01); *F15B 2211/40515* (2013.01); *F15B 2211/413* (2013.01); *F15B 2211/41581* (2013.01); *F15B 2211/428* (2013.01); *F15B 2211/46* (2013.01)

(58) Field of Classification Search
CPC ..... B66F 5/04; F15B 15/204; F15B 2211/46
USPC ..... 91/404
See application file for complete search history.

(56) References Cited

U.S. PATENT DOCUMENTS 2,381,553 A * 8/1945 Mott ..... F16K 39/024 137/601.01
3,740,952 A * 6/1973 Fujii ..... B66F 5/04 137/601.01
4,754,692 A 7/1988 Yoshida
5,065,983 A * 11/1991 Slay ..... B66F 5/04 254/8 B
5,675,982 A 10/1997 Kirol et al.
6,199,379 B1 * 3/2001 Hung ..... B66F 5/04 60/479
6,742,334 B2 * 6/2004 Fan ..... F15B 7/04 60/479
6,742,767 B1 * 6/2004 Bruzek ..... B66F 3/42 254/89 H
7,040,091 B2 * 5/2006 Fan ..... B66F 3/42 60/477
2009/0218835 A1 * 9/2009 Sipila ..... B27L 1/08 294/206

(Continued)

FOREIGN PATENT DOCUMENTS

WO 83/00542 A1 2/1983

OTHER PUBLICATIONS

Notification of Transmittal of the International Search Report and the Written Opinion of the International Searching Authority, or the Declaration dated Mar. 23, 2016 for International Application No. PCT/US2015/067305 (12 pages).

*Primary Examiner* — Thomas E Lazo
(74) *Attorney, Agent, or Firm* — Taylor IP, P.C.

(57) ABSTRACT

A hydraulic jack including a load cylinder, a pump, a release valve and a flow regulator. The pump is configured to provide pressurized fluid to the load cylinder. The release valve is in fluid communication with the pressurized fluid. The flow regulator is configured to alter a flow path of the fluid therethrough as an inverse function of a pressure drop of the fluid across the flow regulator. The fluid regulator being in fluid communication with the release valve.

18 Claims, 19 Drawing Sheets

(56) References Cited

U.S. PATENT DOCUMENTS

2014/0158962 A1 6/2014 Lautzenhiser et al.

* cited by examiner

FLUID FLOW REGULATOR

BACKGROUND OF THE INVENTION

1. Field of the Invention

The present invention relates to a hydraulic flow regulator, and, more particularly, to a regulator that controls a fluid flow as the pressure of the fluid fluctuates, for instance in a jack.

2. Description of the Related Art

Hydraulic cylinders are common devices used in industry and for the jacking of loads using a jacking mechanism having an input cylinder and an output cylinder. The output cylinder is used to lift the load to a predetermined height with a considerably small force utilized on the mechanical portion that moves the input cylinder. The working principal of the hydraulic jack system provides for an applied small force that moves the input piston of a small cross-sectional area and pushes the hydraulic fluid or oil into an output cylinder, which then forces an output piston of large cross-sectional area to jack up a load.

When an operator of a hydraulic jack needs to lower the load that has been jacked up, the operator typically operates a release valve to allow the fluid to escape the load cylinder. Generally the release valve is a screw that has very little resolution and the fluid will rapidly escape to the fluid reservoir when the output cylinder is under a full load, then as the load comes into contact with a support, thus lowering the load supported by the jack, the pressure in the load cylinder fluid changes and the fluid flow decreases. This disadvantageously then reduces the rate of lowering of the load.

From another perspective the initial lowering speed is generally too high. For example, with a vehicle in a raised position, as the screw valve is moved the vehicle will often lurch downwardly. This can be potentially hazardous to the operator, a condition which it is desirous to avoid.

What is needed in the art is an easy to operate, and inexpensive to manufacture, flow regulator that can be easily incorporated into a jack.

SUMMARY OF THE INVENTION

The present invention provides a hydraulic flow regulator that controls the rate of flow in a hydraulic system such as a jack over a large dynamic range by altering flow pathways of the fluid.

The invention in one form is directed to a hydraulic jack including a load cylinder, a pump, a release valve and a flow regulator. The pump is configured to provide pressurized fluid to the load cylinder. The release valve is in fluid communication with the pressurized fluid. The flow regulator is configured to alter a flow path of the fluid therethrough as an inverse function of a pressure drop of the fluid across the flow regulator. The fluid regulator being in fluid communication with the release valve.

The invention in another form is directed to a hydraulic pump supplying pressurized fluid to a load cylinder including a release valve and a flow regulator. The release valve is in fluid communication with the pressurized fluid. The flow regulator is configured to alter a flow path of the fluid therethrough as an inverse function of a pressure drop of the fluid across the flow regulator. The fluid regulator being in fluid communication with the release valve.

The invention in yet another form is directed to a method of method of retracting a hydraulic cylinder under a load. The method includes the steps of releasing a valve and altering a flow path of fluid. The releasing a valve step allows a valve in fluid communication with pressurized fluid in the cylinder to flow. The altering a flow path of the fluid alters a flow of the fluid in a flow regulator as a pressure drop of the fluid across the flow regulator changes. The fluid regulator being in fluid communication with the valve.

An advantage of the present invention is that the flow regulator works over a large dynamic range.

Another advantage of the present invention is that it is involves few moving parts.

Yet another advantage of the present invention is that the apparatus is inexpensive to manufacture and can be readily adapted into systems currently using prior art designs.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrate one embodiment of the invention and such exemplification is not to be construed as limiting the scope of the invention in any manner.

DETAILED DESCRIPTION OF THE INVENTION

Figure 1:
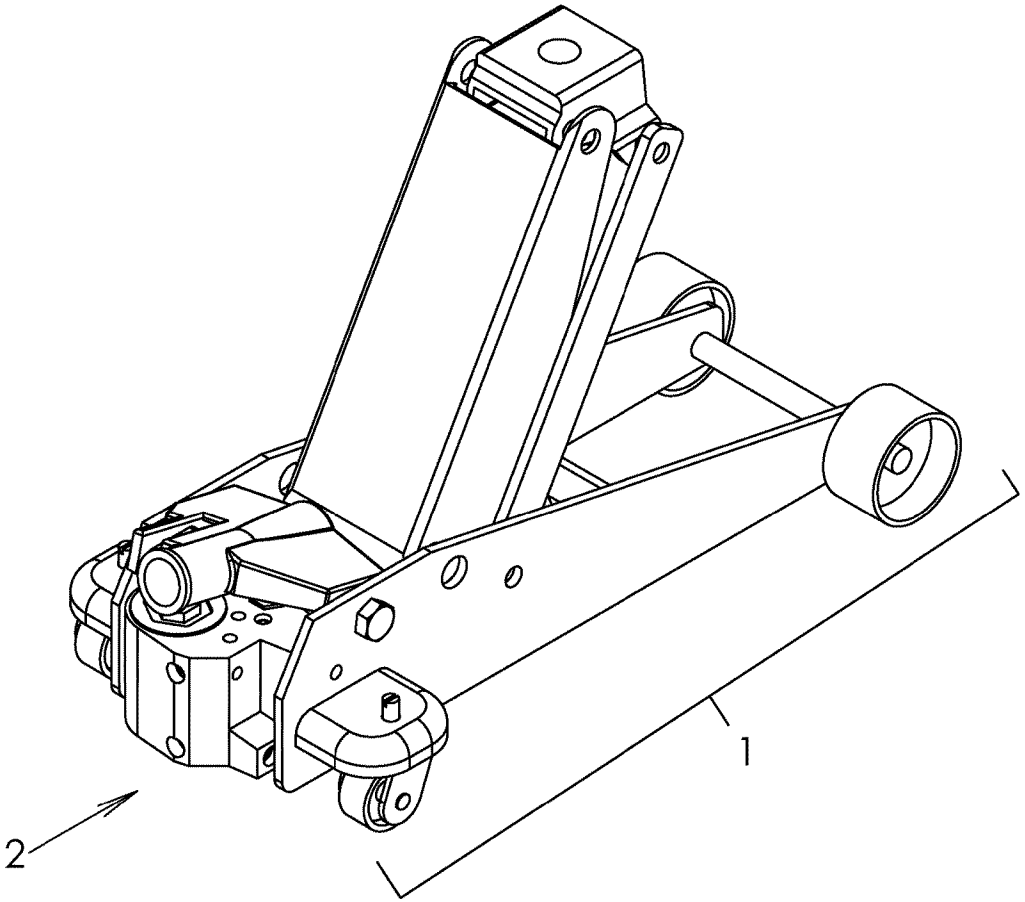
FIG. 1 is a perspective view that illustrates an application of an embodiment of the present invention in the form of a manually operated hydraulic jack.
Figure 2:
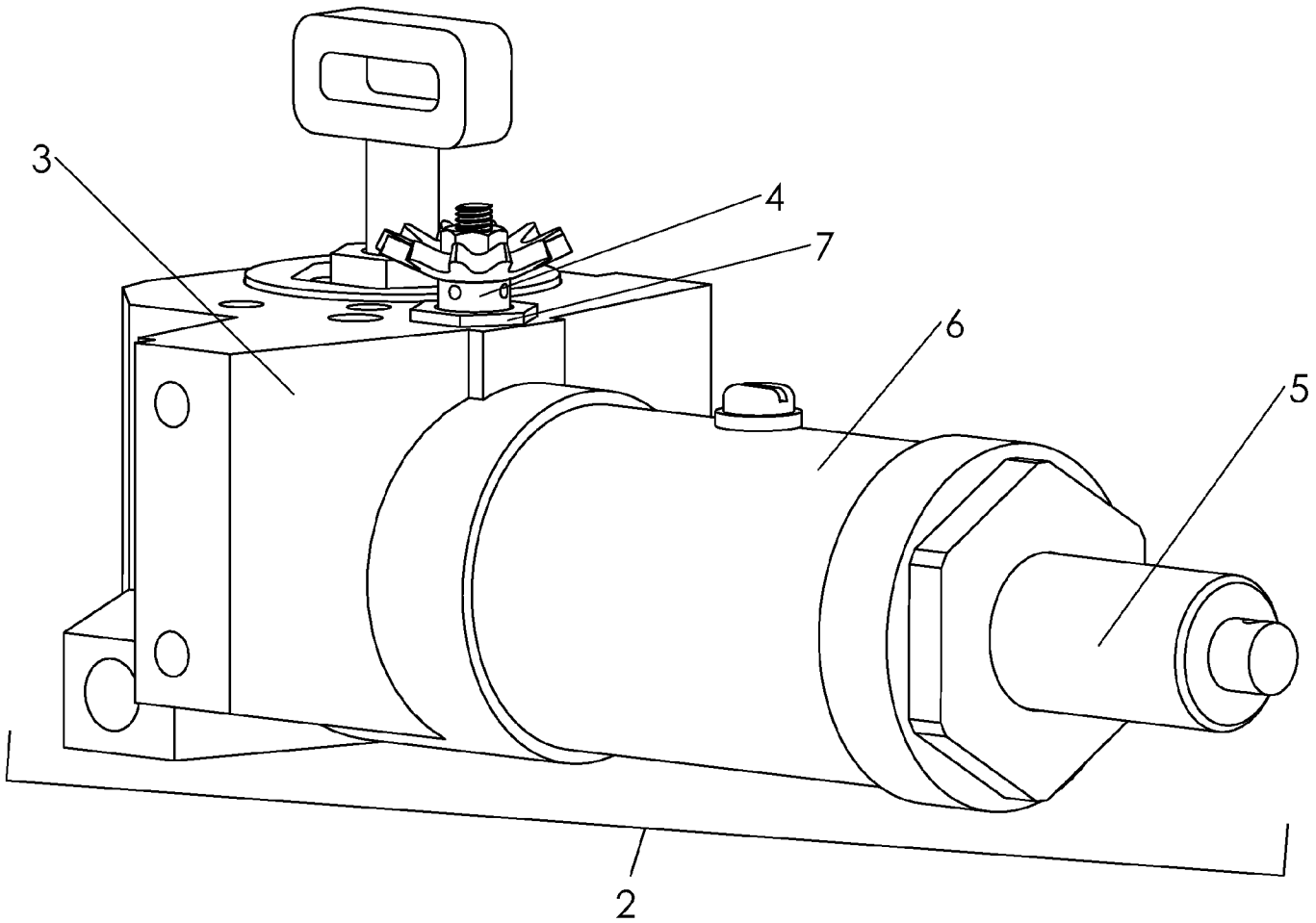
FIG. 2 is a perspective view of part of the hydraulic jack of FIG. 1.
Figure 3:
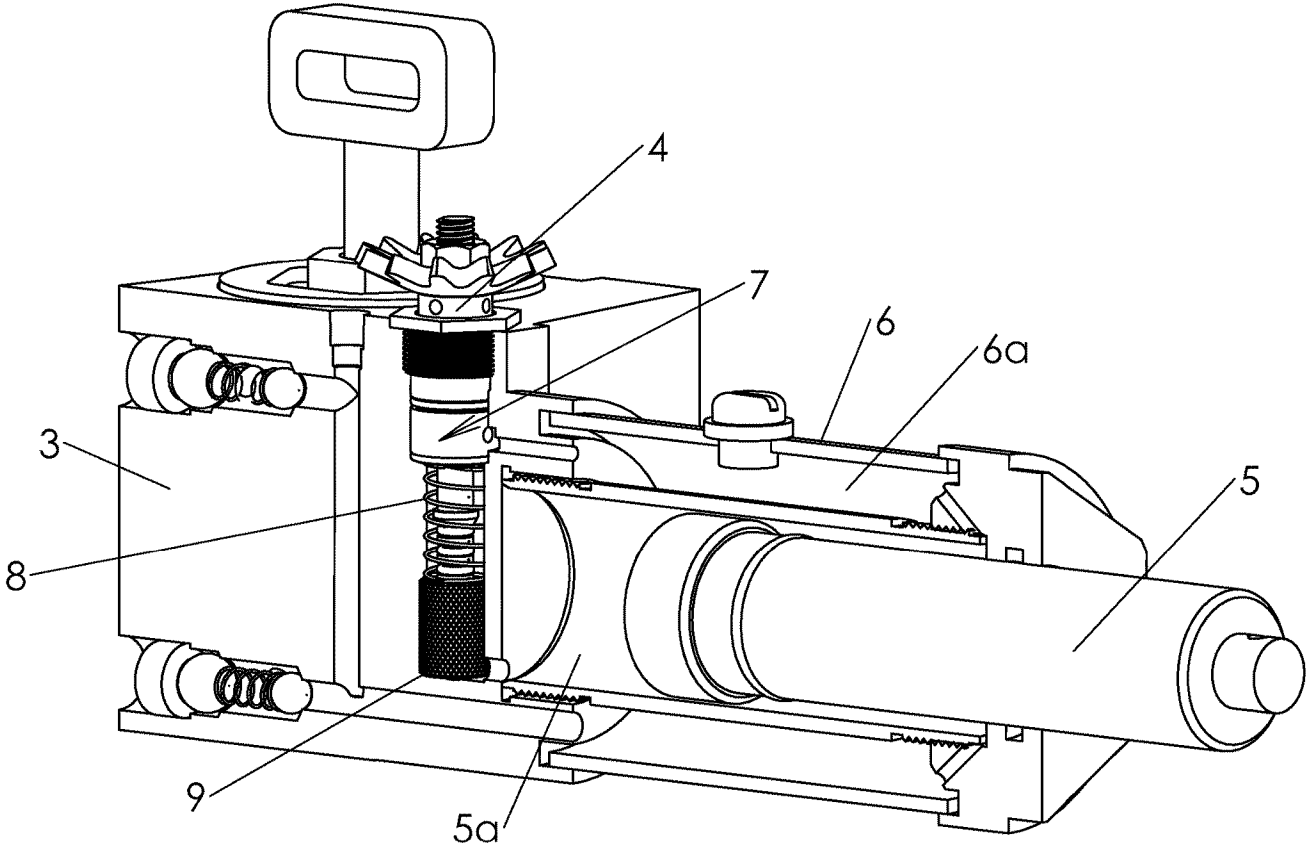
FIG. 3 is a partially sectioned view of the output cylinder of the jack of FIGS. 1 and 2 illustrating a flow regulator of the present invention.
Figure 4:
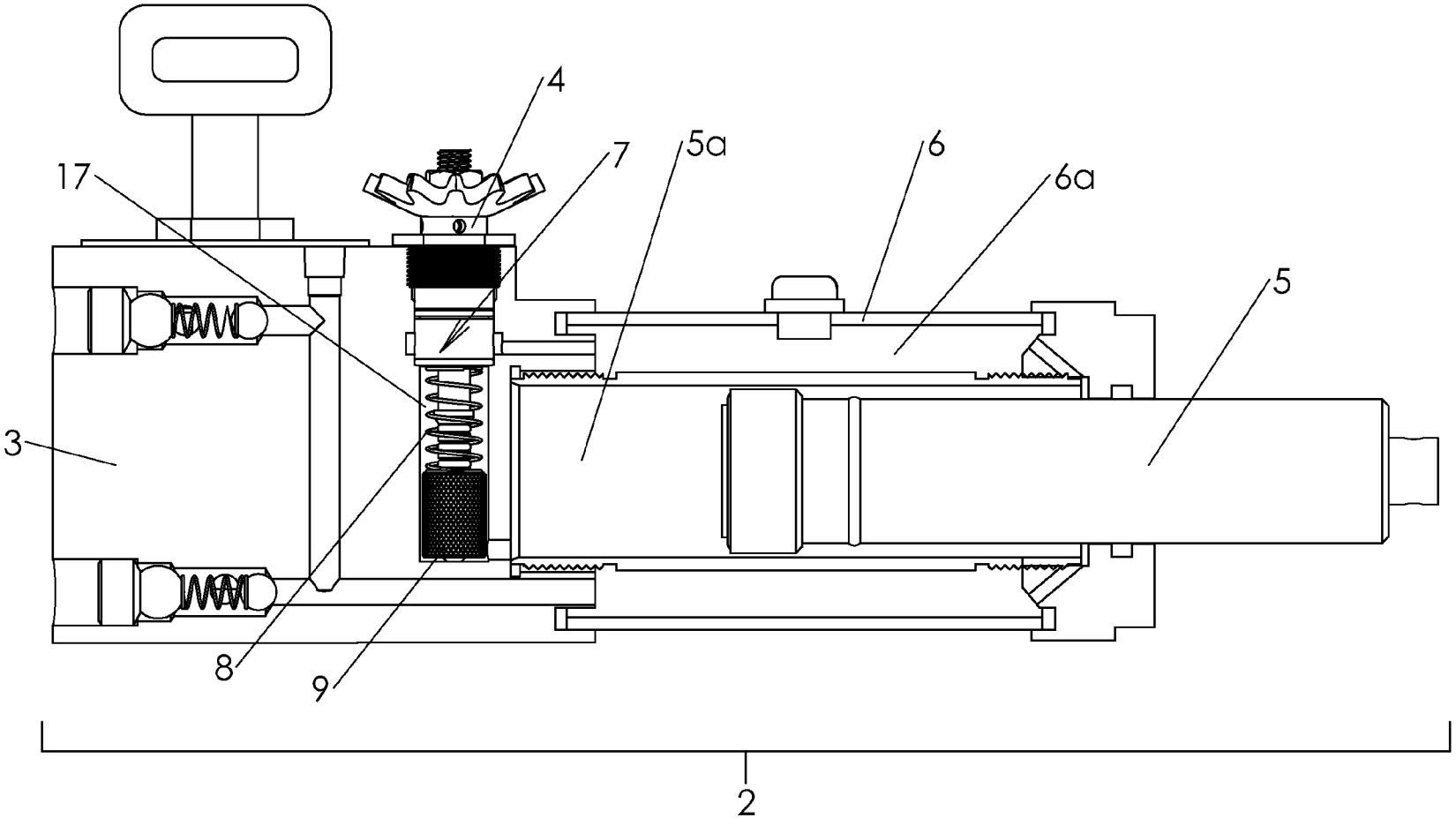
FIG. 4 is a partial cutaway view of the output cylinder of FIGS. 2 and 3.

Referring now to the drawings, and more particularly to FIG. 1, there is shown a hydraulic jack 1 having a frame, and a hydraulic pump 2. Hydraulic jack 1 is similar on the exterior of numerous jack systems currently in use. Jack 1 is rolled under a device, such as a vehicle, and it is positioned so that the lifting arm will engage a portion of the underside of the car. A handle (not shown) is pumped up and down to actuate hydraulic pump 2, which causes the lifting arm to extend and lift a load.

Now, additionally referring to FIGS. 2-15 there is illustrated an embodiment of the present invention of a flow regulator 7, with associated structure including a housing or body 3, a release valve 4, a lifting ram 5, a lifting ram cavity 5*a*, a tank shell 6, a tank shell cavity 6*a*. The flow regulator 7 itself includes a spring 8, a plunger 9, release O-ring seals 10, plunger O-ring seals 11, ports 12, 13, 14 and 15, a flow channel 16 and a cavity 17.

Figure 8:
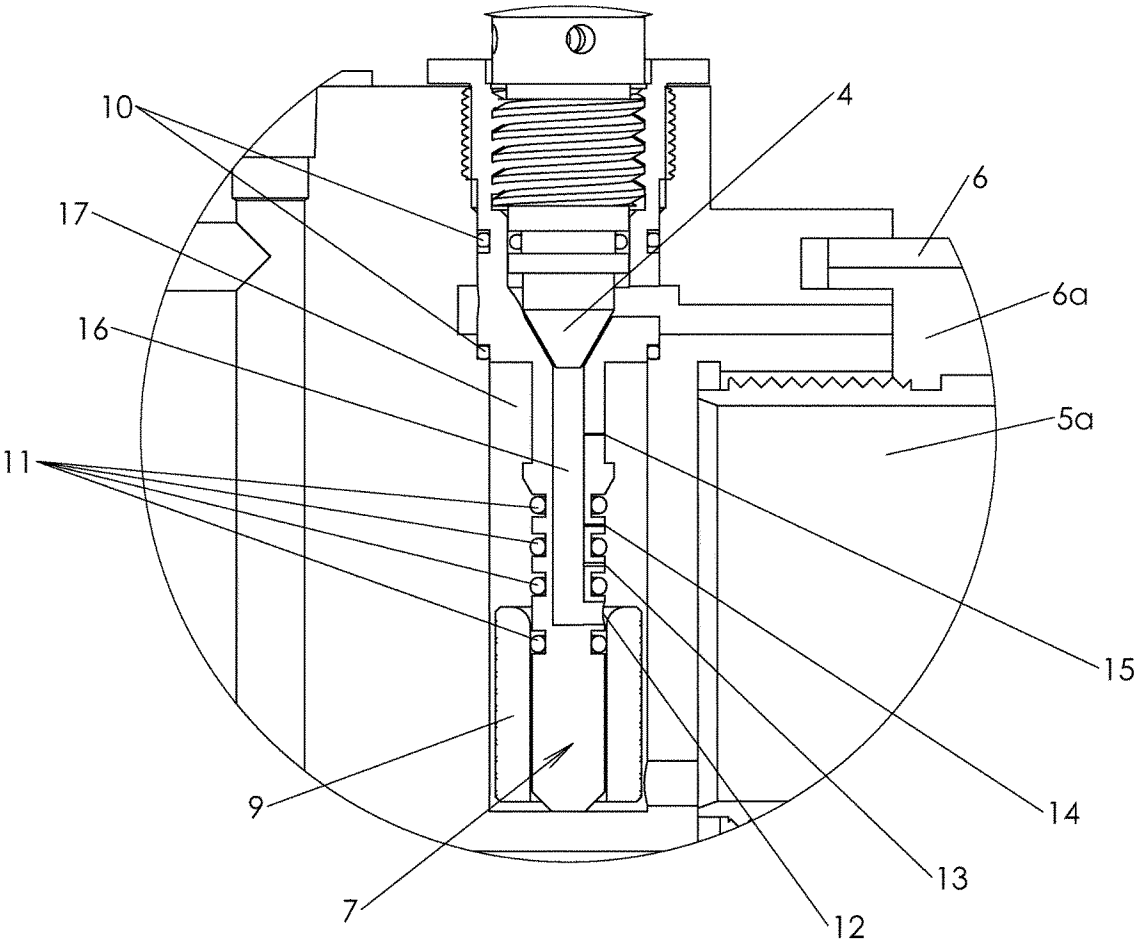
FIG. 8 is a cutaway view of the flow regulator of FIGS. 3-7, in a low pressure or initial flow configuration.

During a lifting operation release valve 4 is tightened as shown in FIG. 8 to prevent pressurized fluid in lifting ram cavity 5*a* from escaping and pump 2 is actuated causing fluid to flow into cavity 5*a*. As the fluid in cavity 5*a* increases lifting ram 5 is extended to lift the load (not shown).

Figure 10:
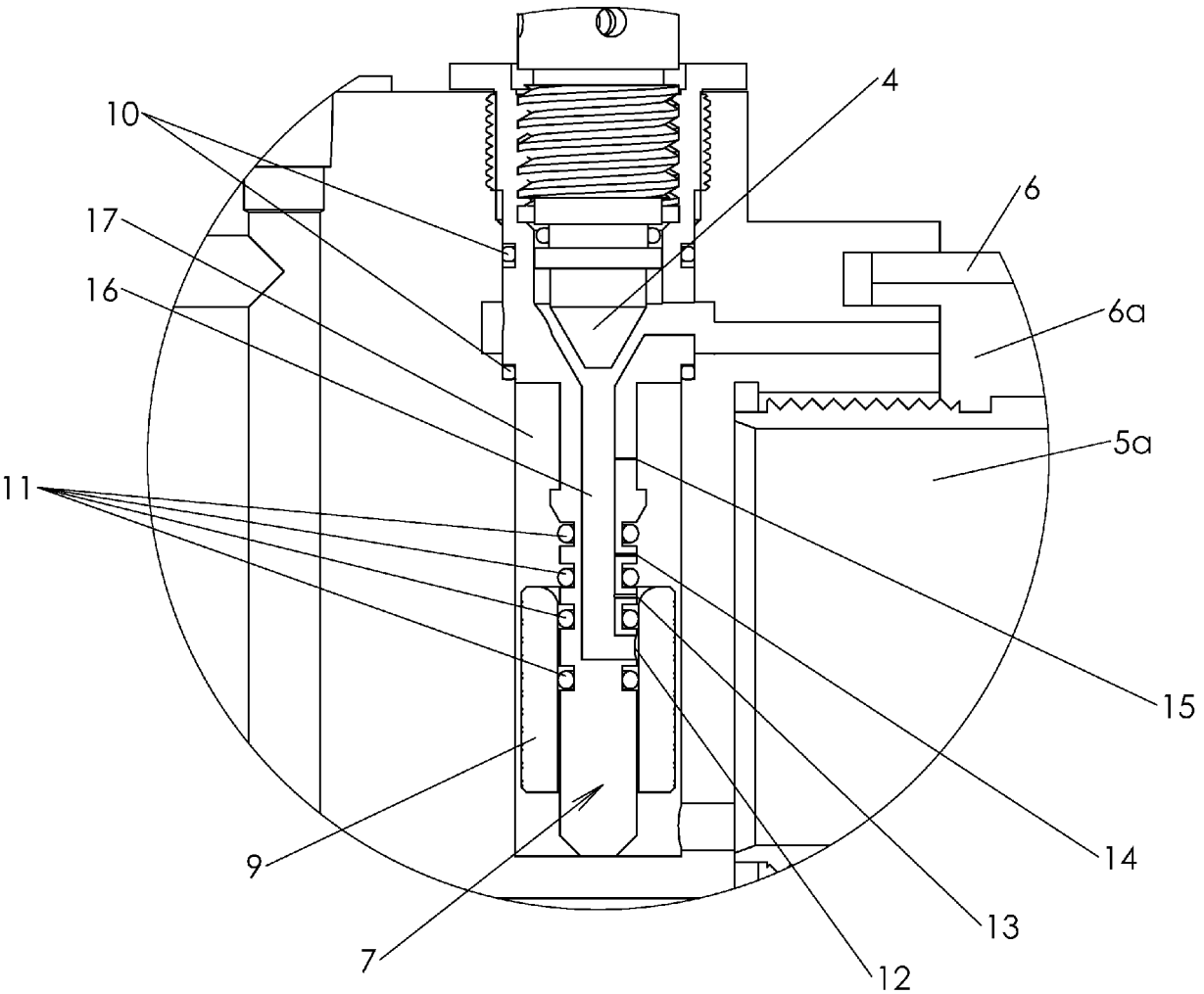
FIG. 10 is a cutaway view of the flow regulator of FIGS. 3-9 at an intermediate pressure flow configuration.
Figure 12:
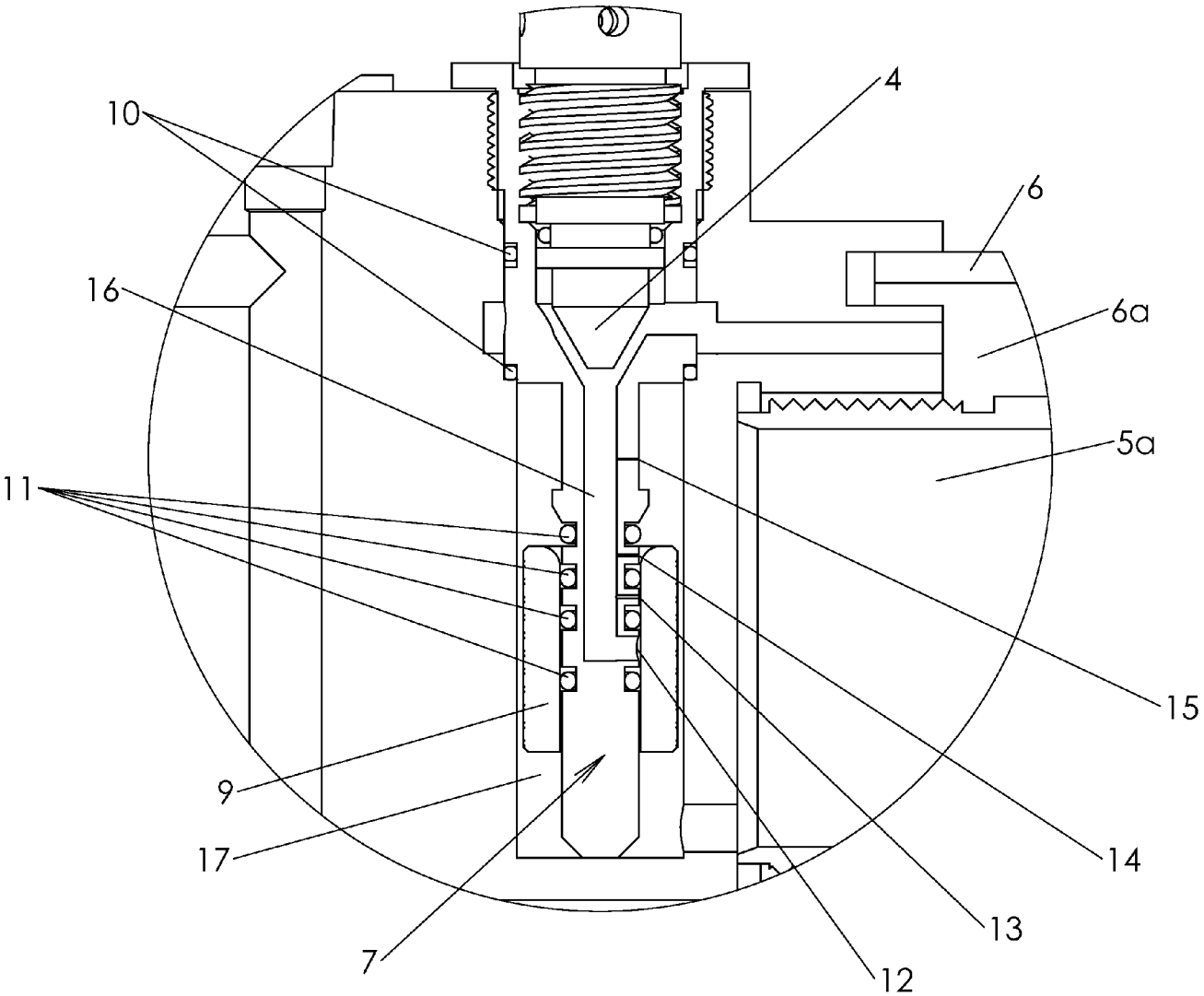
FIG. 12 is a cutaway view of the flow regulator of FIGS. 3-11 in a near full pressure flow configuration.
Figure 14:
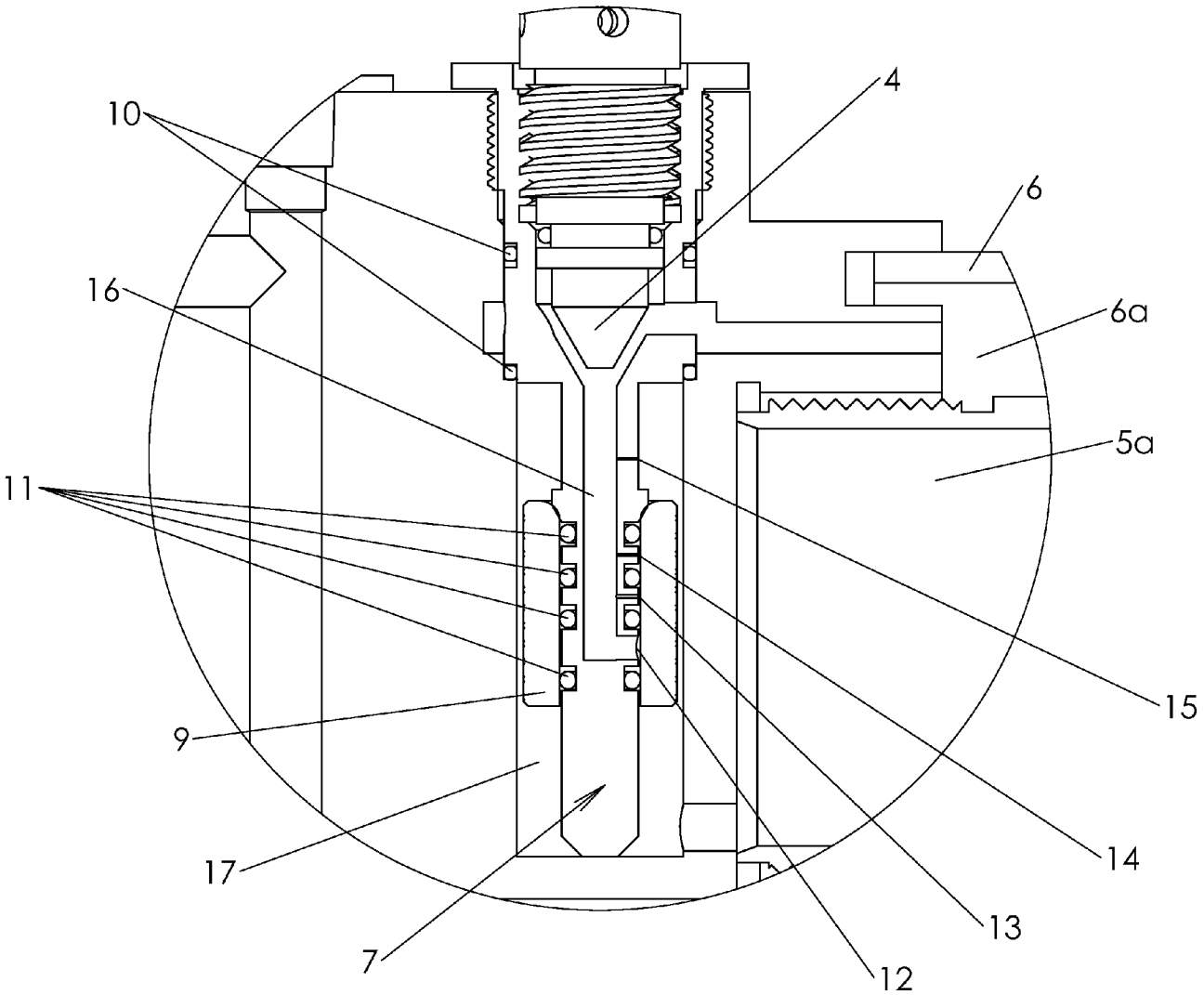
FIG. 14 is a cutaway view of the flow regulator of FIGS. 3-13 in a full pressure flow configuration.
Figure 15:
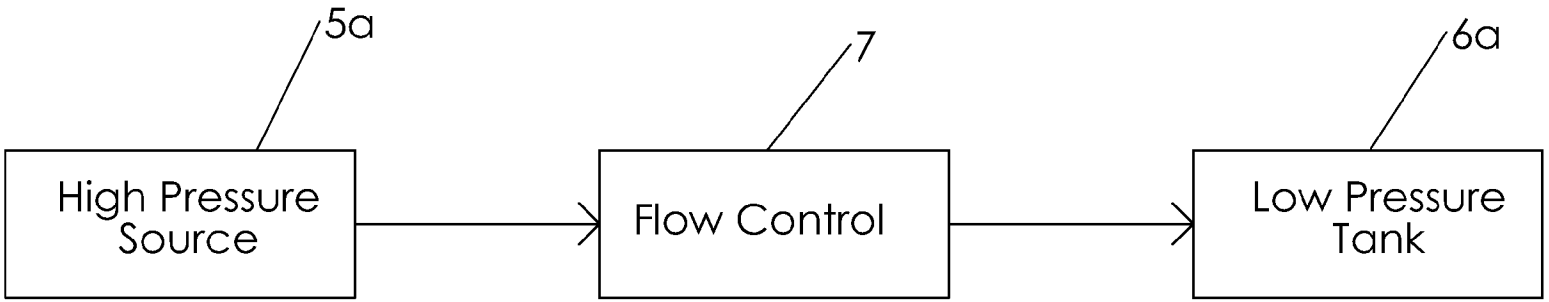
FIG. 15 is a schematic illustration of an embodiment of the flow control system of FIGS. 1-14.

When it is time to lower the load, release valve 4 is loosened as shown in FIGS. 10, 12 and 14, this allows pressurized fluid in cavity 5*a* to flow through flow regulator 7 to the low pressure tank cavity 6*a*, as illustrated in FIG. 15. The fluid flow through flow regulator 7 will cause plunger 9, which can also be thought of as a sleeve 9, to move in the direction of the fluid flow (which is up in these drawings) and against spring 8, also known as a biasing member 8. As plunger 9 moves up, ports 12, 13 and 14 are sealed from the flow leaving only port 15 open to accommodate the flow of fluid from cavity 5*a* to cavity 6*a*.

Figure 5:
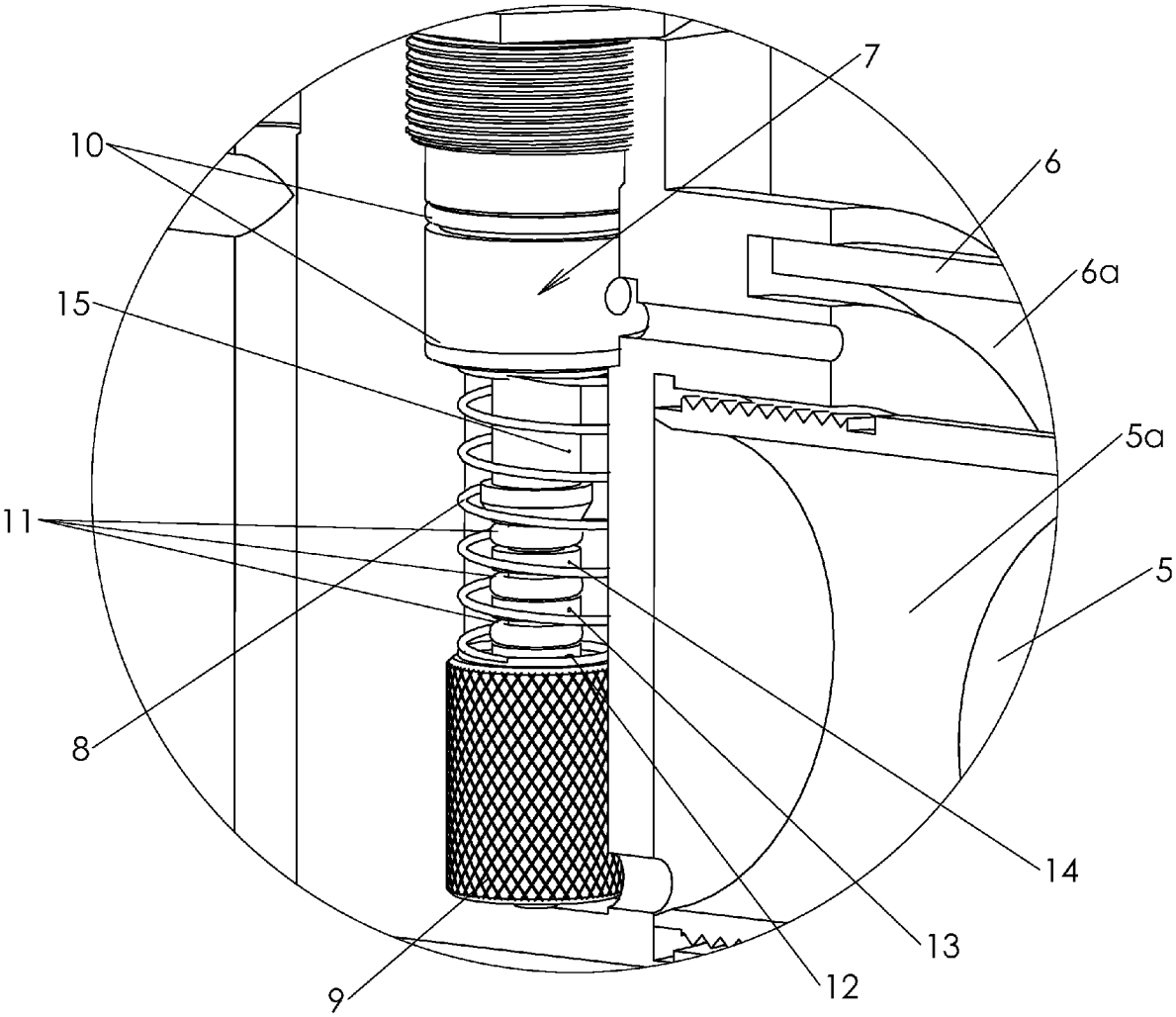
FIG. 5 illustrates a perspective close up view of the flow regulator of FIGS. 3 and 4.
Figure 6:
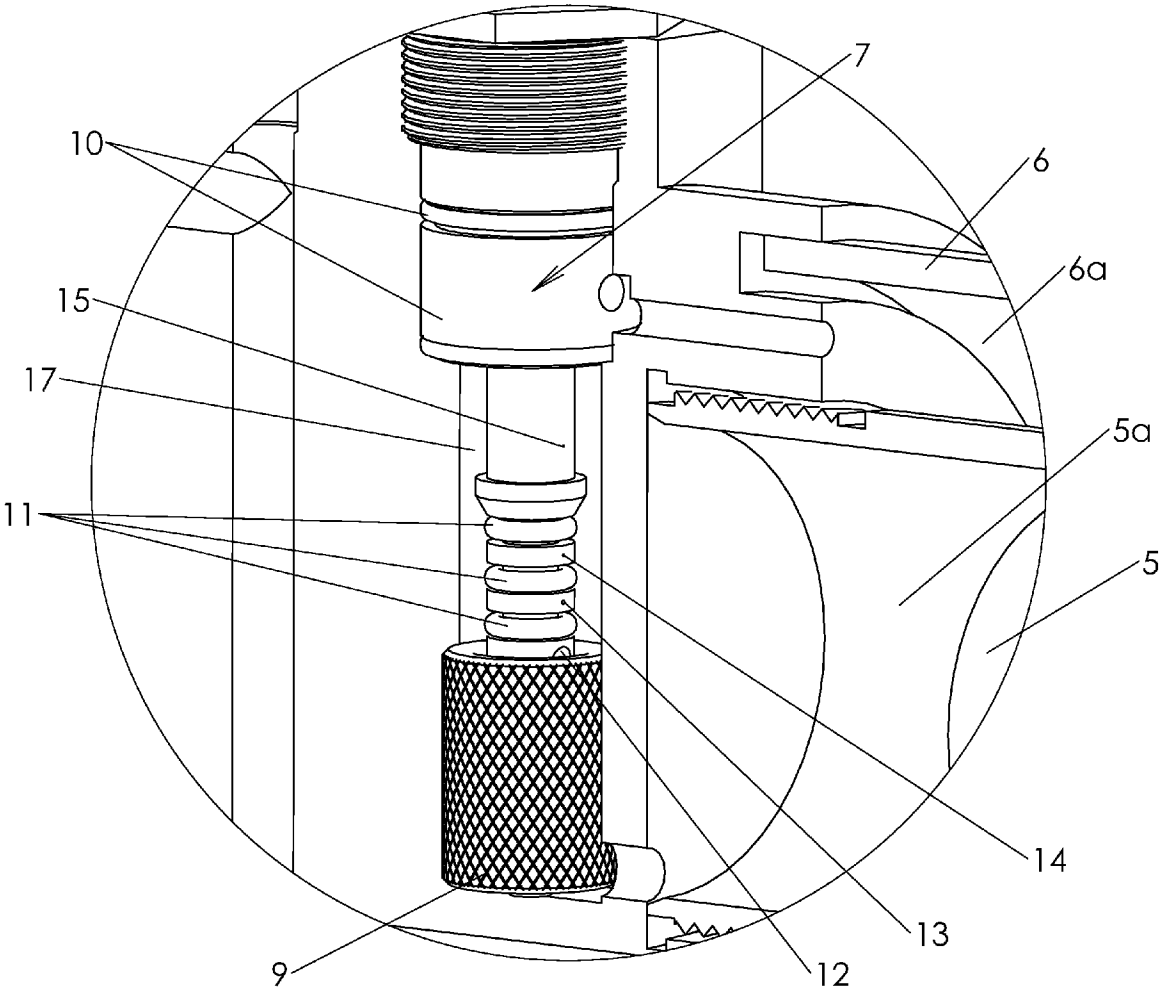
FIG. 6 is another view of the flow regulator of FIGS. 3-5, with the spring removed.
Figure 9:
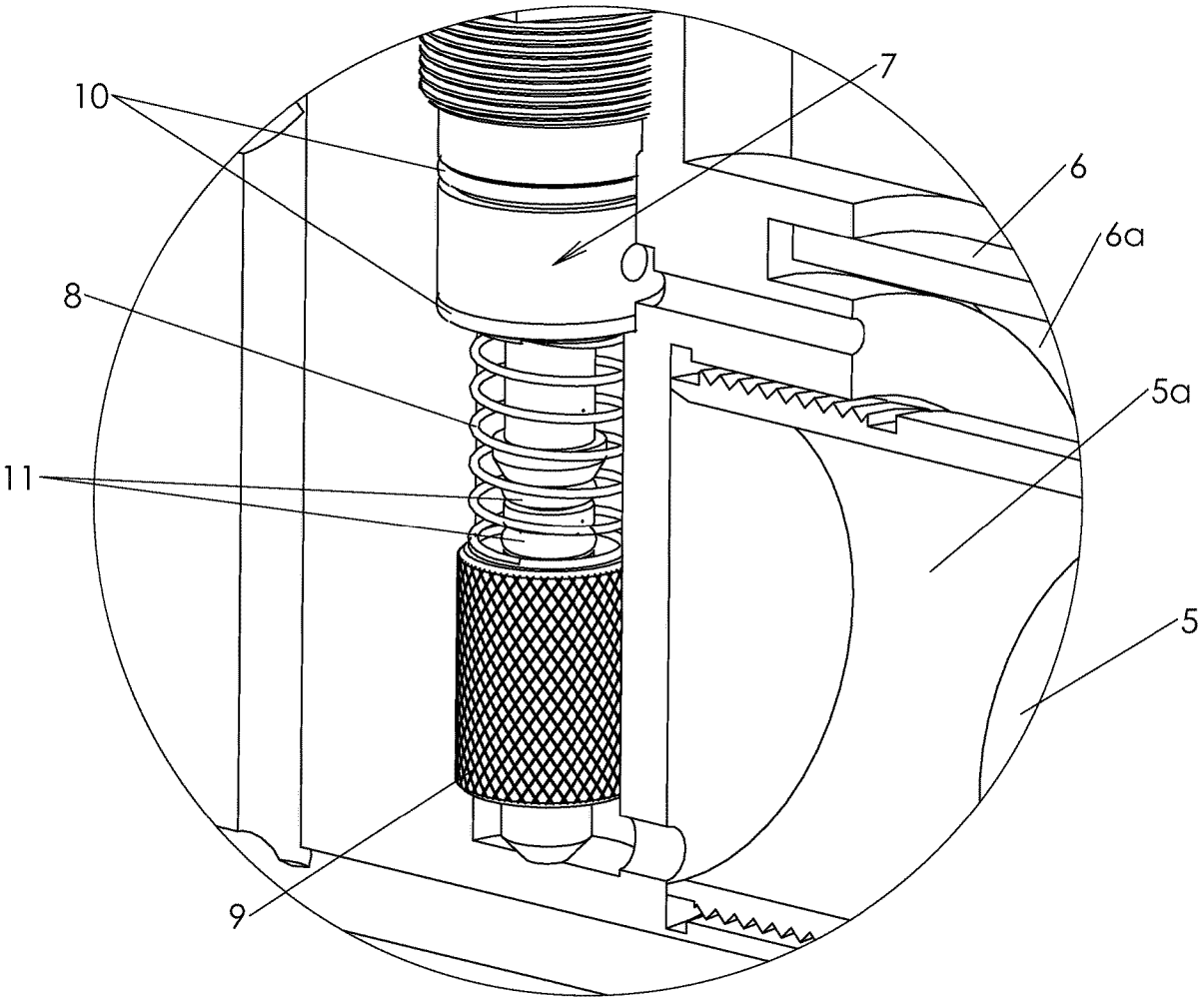
FIG. 9 is a perspective view of the flow regulator of FIGS. 3-8 at an intermediate pressure flow configuration.
Figure 11:
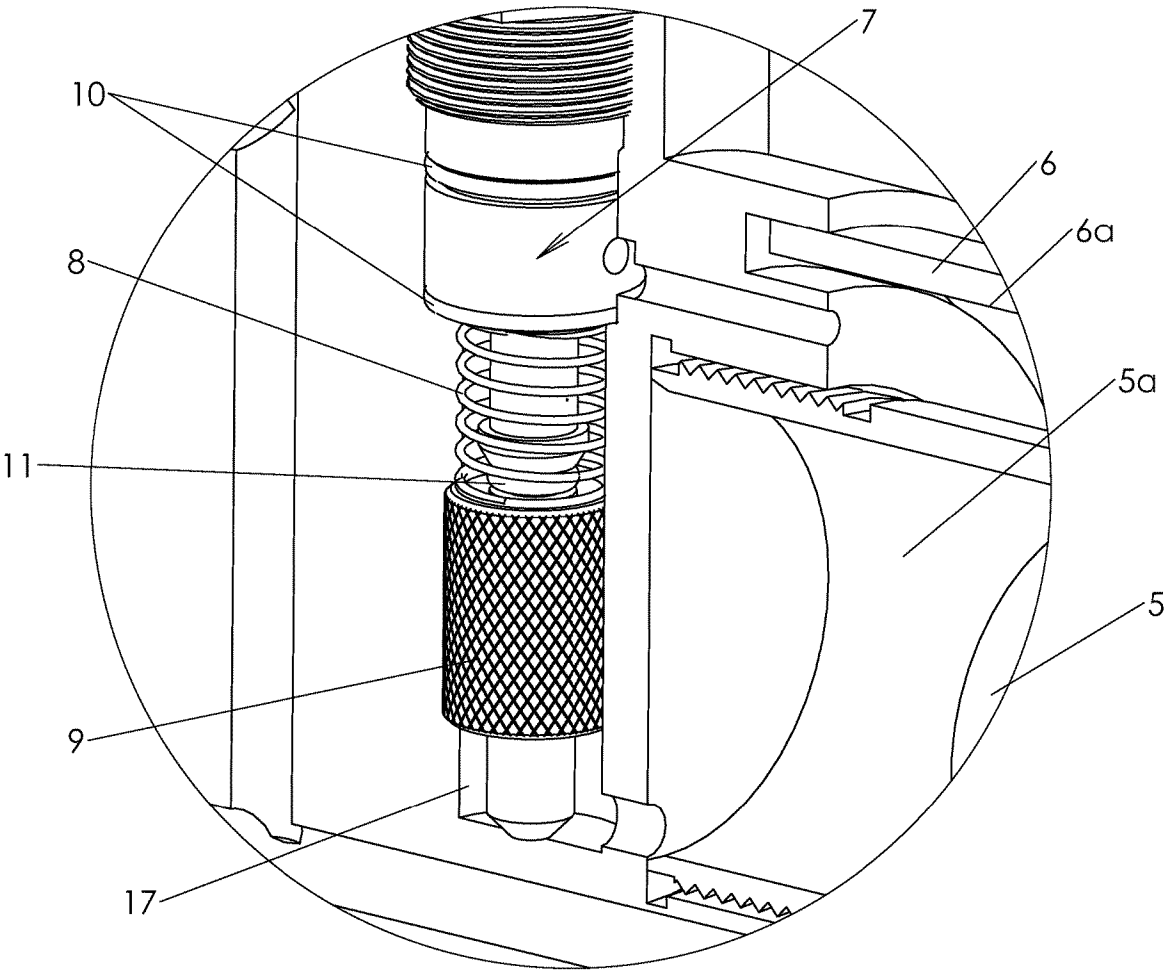
FIG. 11 is a perspective view of the flow regulator of FIGS. 3-10 in a near full pressure flow configuration.
Figure 13:
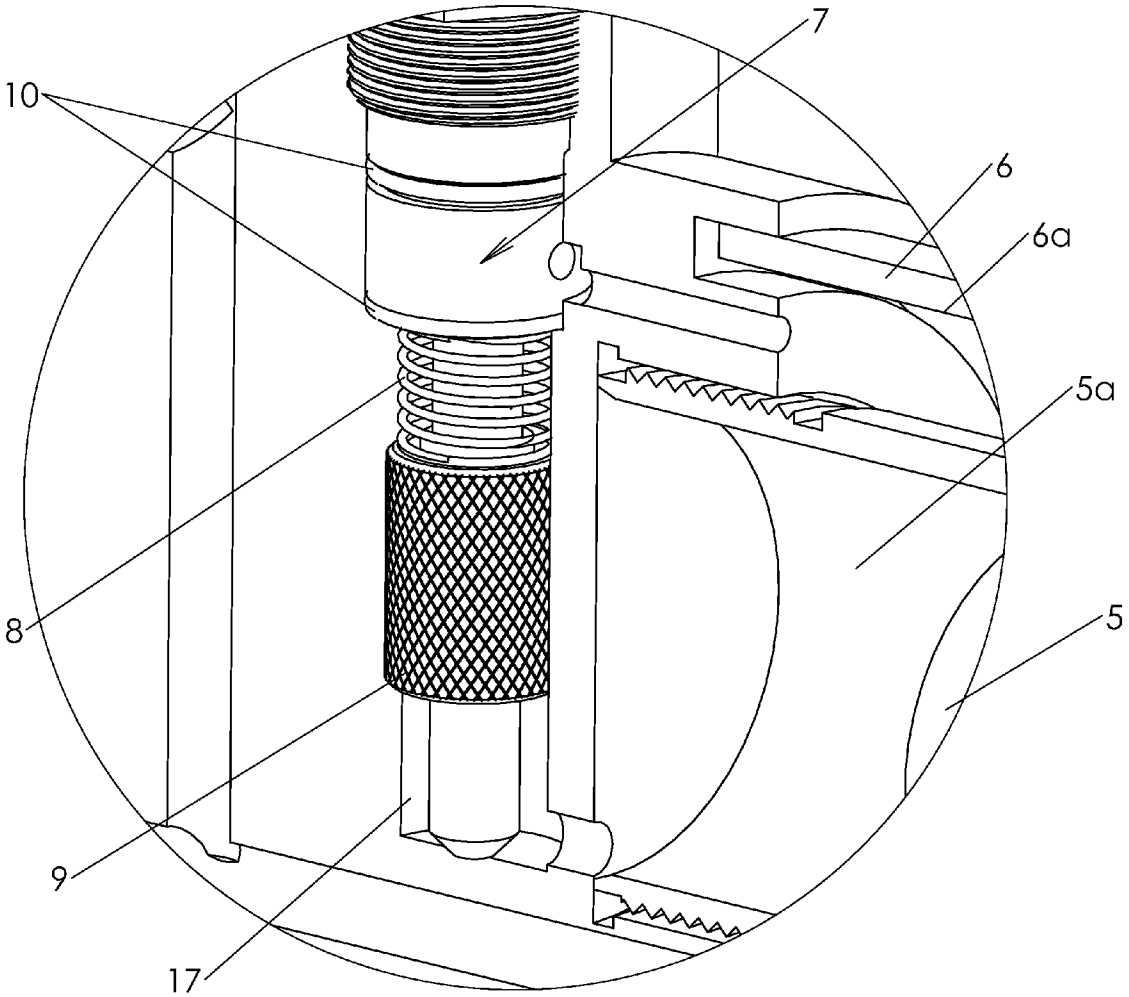
FIG. 13 is a perspective view of the flow regulator of FIGS. 3-12 in a full pressure flow configuration.

The sequence of movement of plunger 9 and spring 8, in reaction to a movement of a high pressure level of the fluid in cavity 5*a*, can be seen as progressing from FIGS. 5 and 8 before opening valve 4, to FIGS. 9 and 10 after opening valve 4, then to FIGS. 11 and 12, then to FIGS. 13 and 14. With a high pressure differential across flow regulator 7, the transitions of the position of plunger 9 and spring 8 may be very rapidly achieved. This then lets the pressurized fluid to flow only from cavity 17 through port 15 into flow channel 16 and then into tank cavity 6*a*.

As lifting ram 5 retracts under the load, as the load decreases, the pressure on the fluid in cavity 5*a* will decrease, and hence the pressure drop across flow regulator 7 will decrease. This will allow the bias of spring 8 to cause plunger 9 to descend, as in going from the position depicted in FIGS. 13 and 14, to the position illustrated in FIGS. 11 and 12, which opens an additional fluid pathway through port 14, which increases the cross-sectional area through which fluid can flow at a now reduced pressure drop across flow regulator 7. This can also be described as altering the fluid flow path, by increasing the effective opening from a high pressure flow to a reduced pressure flow.

In a like manner, as lifting ram 5 continues to retract under the load, and as the load further decreases, the pressure on the fluid in cavity 5*a* will also further decrease, and hence the pressure drop across flow regulator 7 will further decrease. This allows the bias of spring 8 to further move plunger 9, as in going from the position depicted in FIGS. 11 and 12, to the position illustrated in FIGS. 9 and 10, which opens yet another fluid pathway through port 13, which further increases the cross-sectional area through which fluid can flow at a now further reduced pressure. As discussed above this alters the fluid flow path, by increasing the effective opening as the pressure of the fluid decreases, hence an inverse relationship between the flow path size and the pressure drop of the fluid across flow regulator 7.

As can now be understood, as the pressure drop of the fluid continues to decline across flow regulator 7, plunger 9 will reach a low position as shown in FIG. 8 (although with valve 4 still open) and fluid can flow additionally thorough port 12. The sizes of ports 12, 13, 14 and 15 can all be different or some can be the same size. For example, ports 14 and 15 may be the same size and port 13 may be larger, with port 12 being the largest.

As plunger 9 passes each O-ring 11 it substantially seals or opens the path to the corresponding port 12-14, depending on the direction in which plunger 9 is traveling. This can be thought of as opening each level of the arrangement. It is also contemplated to have more than one port at each level, so that multiple ports are opened at each level.

Figure 7:
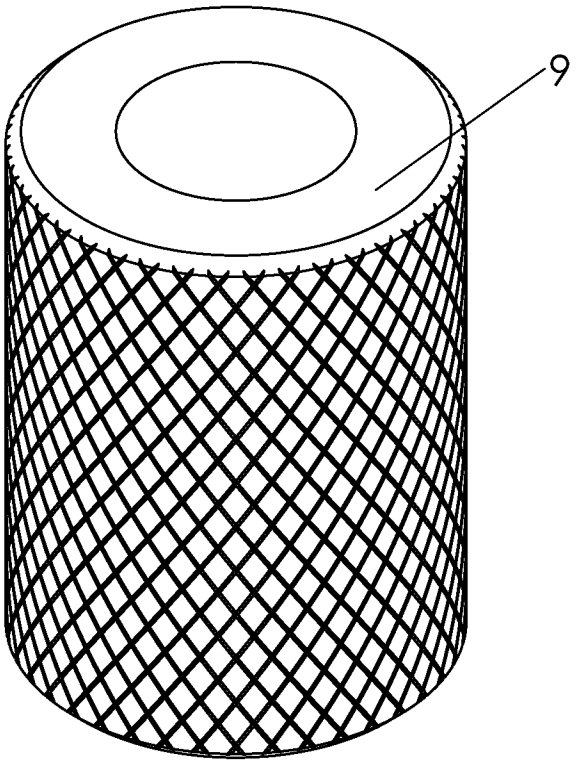
FIG. 7 is a perspective view of part of the flow regulator of FIGS. 3-6.

Plunger 9, which is effectively a sliding cylinder, may have a surface feature, as can be seen in great detail in FIG. 7, such as knurling. The combination of the clearance between plunger 9 and the inner surface of the housing surrounding it along with the surface feature serve to provide a large portion of the force that causes plunger 9 to position itself against the counter bias of spring 8. The flow of the fluid along a side of plunger 9 can be thought of as fluid frictional force, and it is this frictional force that is met by the compression of spring 8 as detailed above.

As discussed above, ports 12-15 can vary in size from each other. In one embodiment of this invention, port 15 has a diameter of 0.006 inches, port 14 has a diameter of 0.006 inches, port 13 has a diameter of 0.013 inches, and port 12 has a diameter of 0.094 inches. Additionally, as plunger 9 slides, and as each seal 11 is passed, to allow some fluid flow through the corresponding hole, there is a transition as the edge of plunger 9 clears each seal so that for a short distance of travel the fluid passing through the hole corresponding to the new flow path is somewhat reduced by the gap between the seal 11 and plunger 9. This effect is transitional, but adds to the overall function of flow regulator 7.

Figure 16:
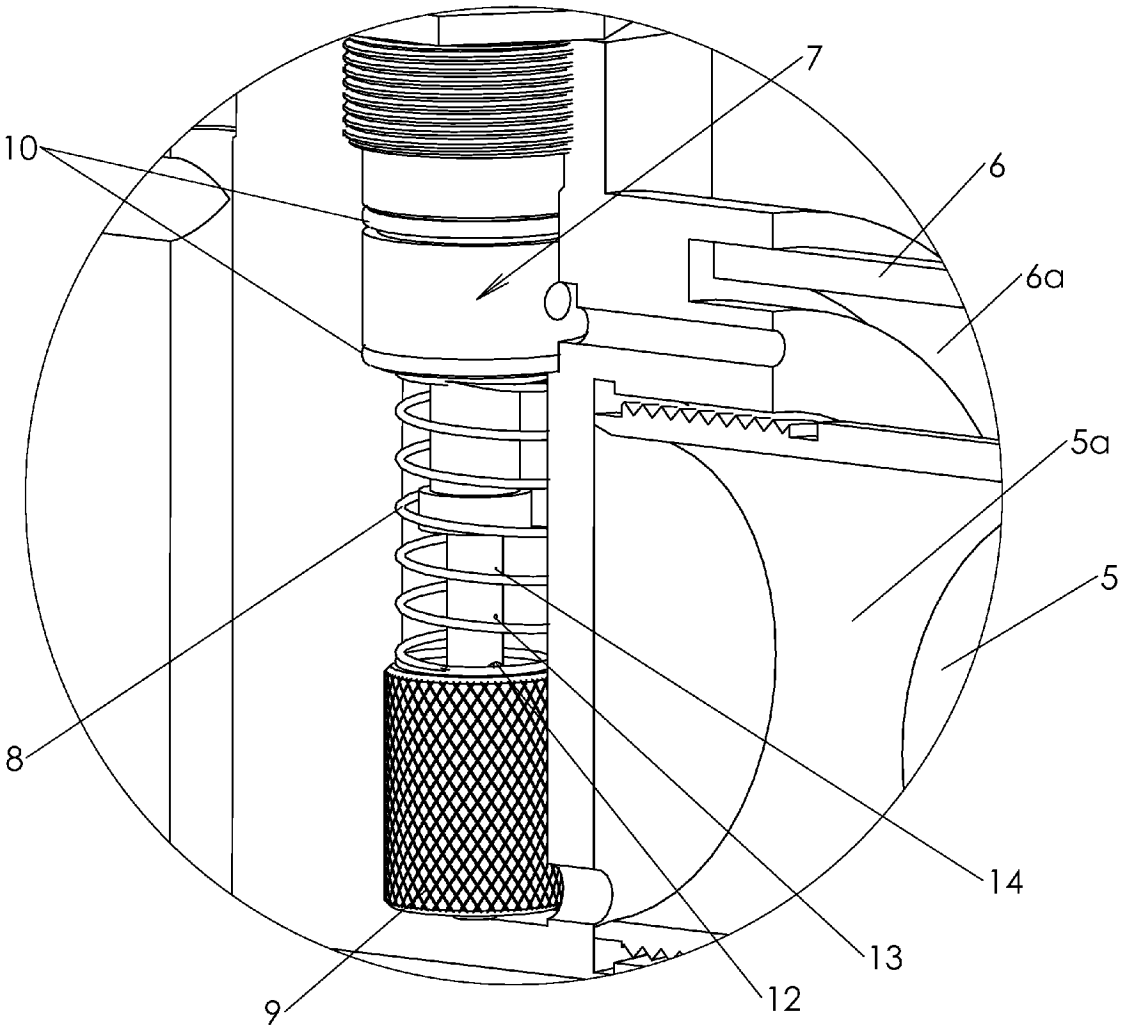
FIG. 16 is a perspective view of another embodiment of the flow regulator of the present invention.
Figure 17:
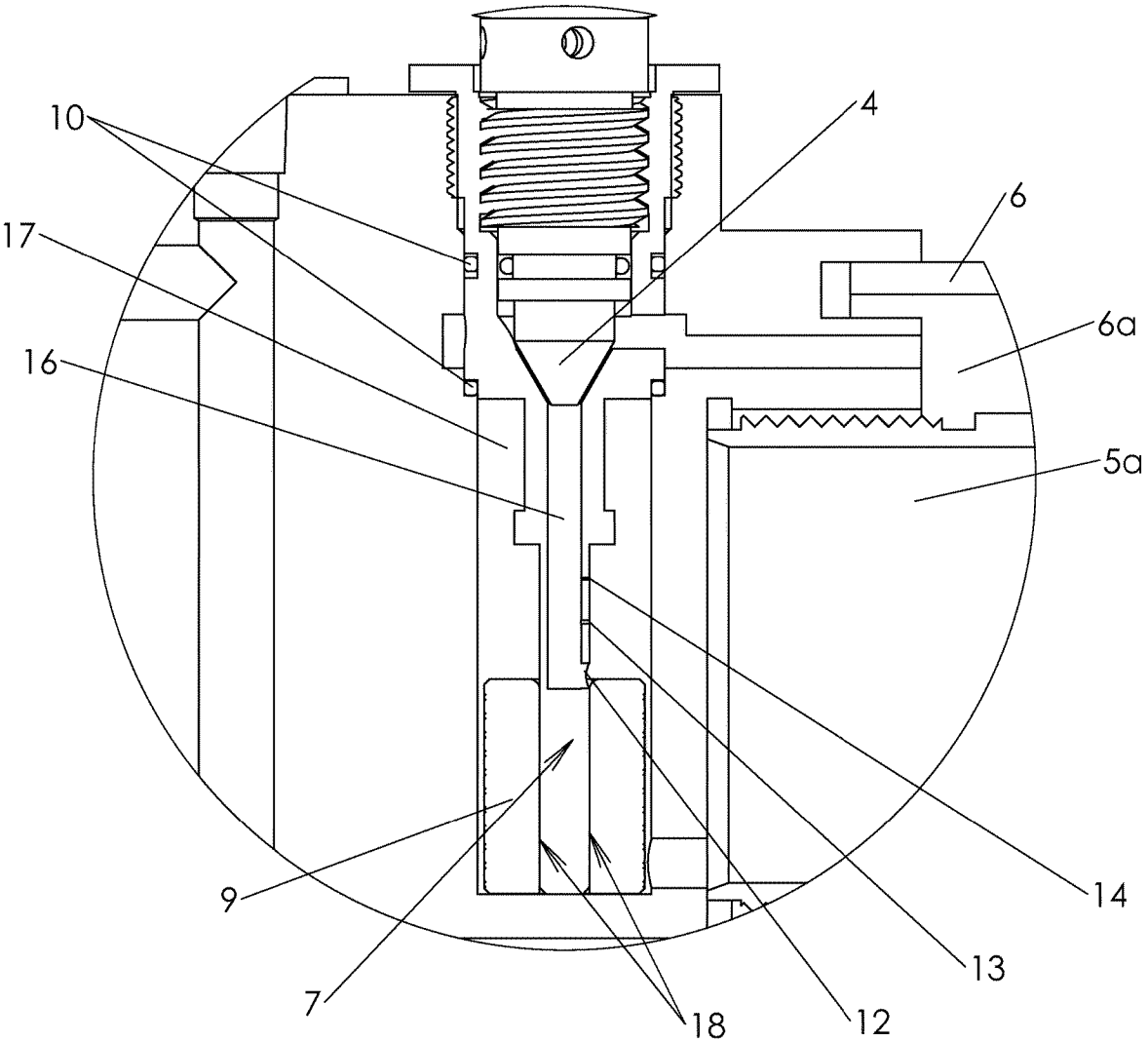
FIG. 17 is a cutaway view of the flow regulator of FIG. 16 in a non-flow configuration.
Figure 18:
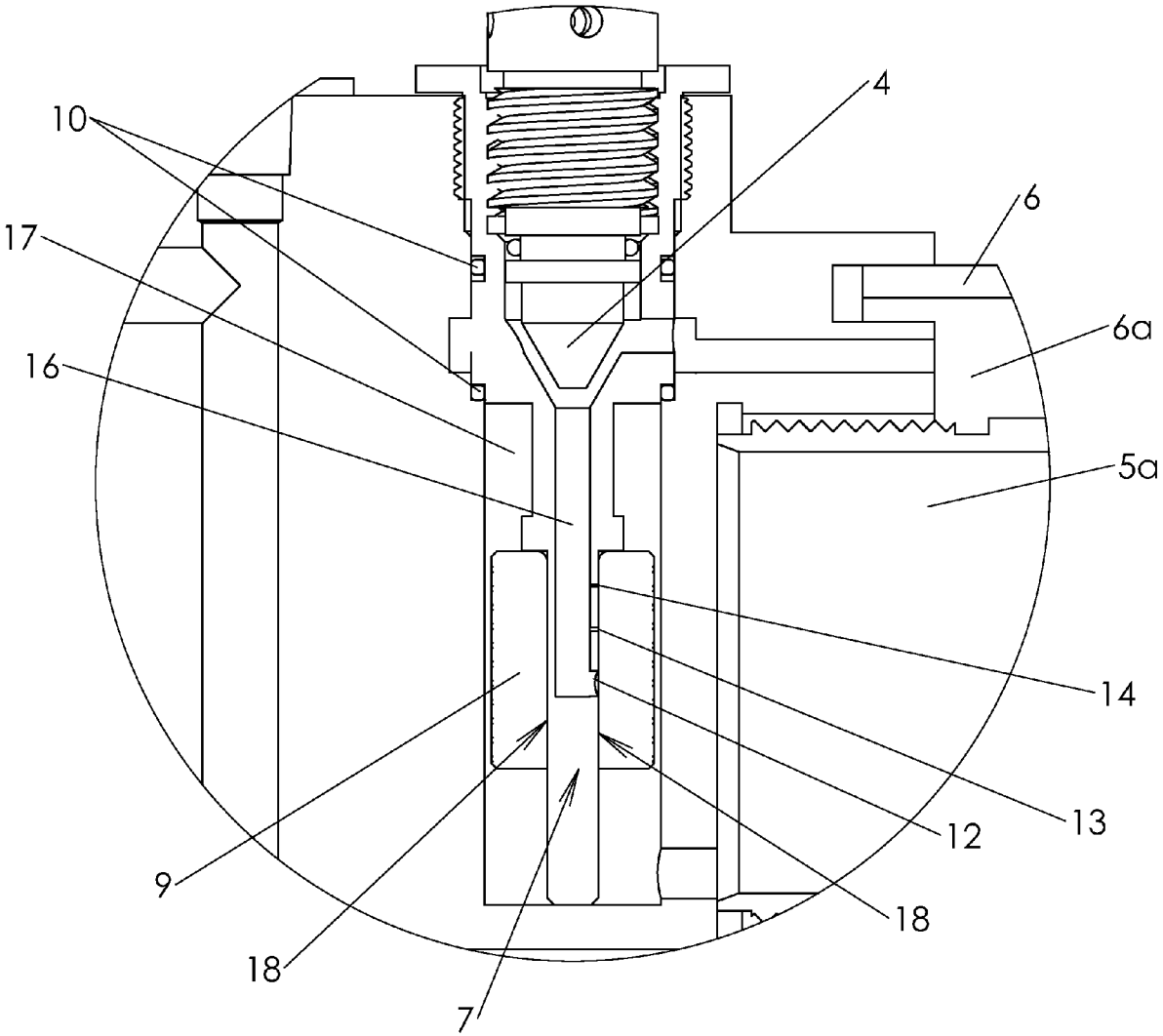
FIG. 18 is a cutaway view of the flow regulator of FIGS. 16 and 17 in a full pressure flow configuration.

Now, additionally referring to FIGS. 16-18 there is shown another embodiment of the present invention. In this embodiment there are no seals 11, and it is gap 18, which serves to act as one of the orifices. As can be seen in FIG. 18, plunger 9 is moved completely up against spring 8 (which is omitted in this view for the sake of clarity) and the flow of the fluid is restricted to substantially that which is flowing through gap 18 or clearance 18 to orifices 12, 13 and 14. It is contemplated that there can be surface features on the inside of plunger 9 as well as along the surfaces that plunger 9 traverses that will serve to provide a flow restriction to cause plunger 9 to move and thereby regulate the fluid flow in flow regulator 7. Here as in the above embodiments, as the pressure drops across plunger 9, spring 8 moves plunger 9 down to thereby expose a larger effective passageway as orifices 14, then 13, then 12 are incrementally opened to fluid flow as the pressure drop across plunger 9 varies.

Figure 19:
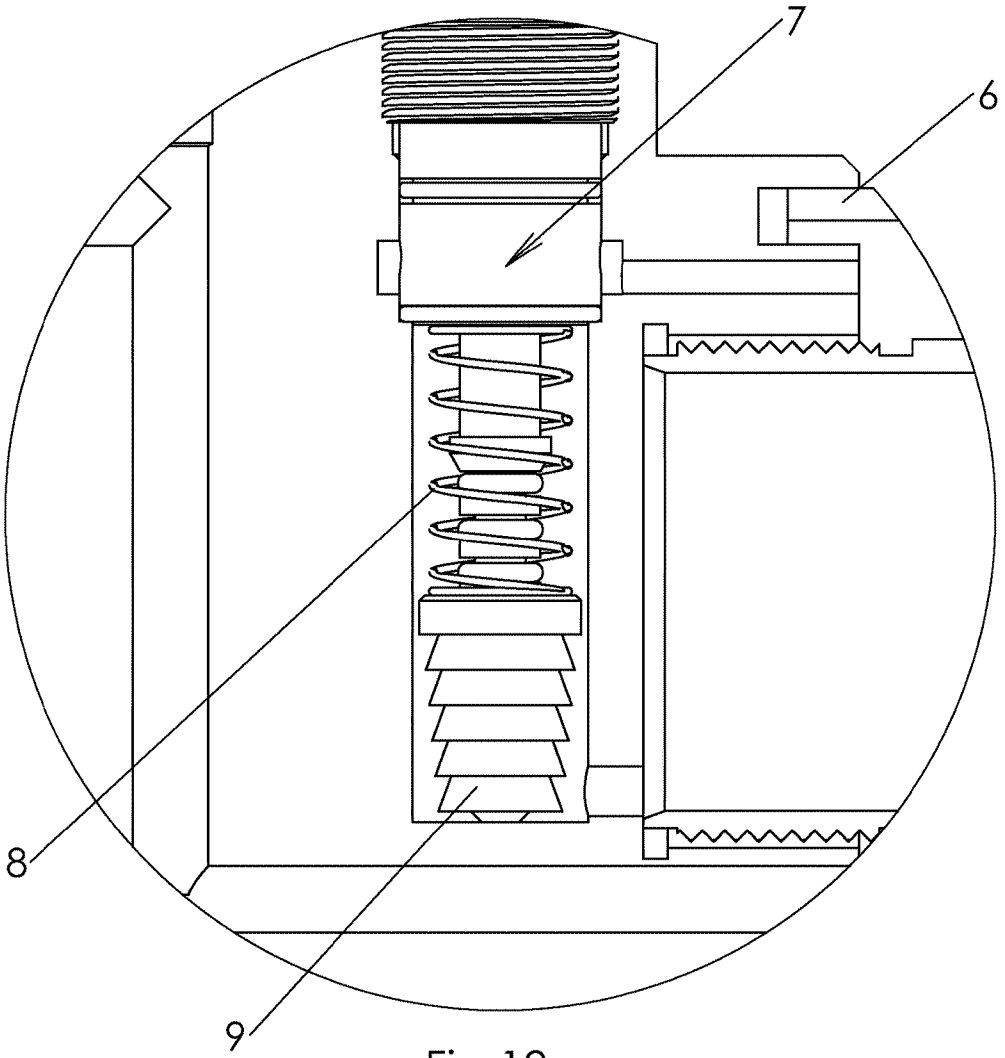
FIG. 19 is a cutaway side view of another embodiment of the flow regulator of the present invention.

Now, additionally referring to FIG. 19 there is shown another embodiment of the present invention. In this embodiment plunger 9 has a stepped barbed appearance with the angled barbs having sequentially differing diameters. This embodiment creates significant turbulence in the liquid flow to thereby allow greater displacement of plunger 9 and allows the impact of the flow to effect plunger 9 to a greater extant. It is contemplated that variations in the pattern and shape of the barbed structure can also be implemented.

Advantageously flow regulator 7 serves to keep a flow moderated over a range of input pressures. The combination of plunger 9, spring 8 and holes 12-15 compensate for pressure changes by altering the cross sectional flow area as the pressure drop varies across flow regulator 7.

Flow regulator 7 will allow a nearly constant flow of oil independent of the pressure. For reference, the oil pressure in the jack varies from approximately 12,000 psi loaded to less than 60 psi unloaded for a ratio of 200:1 or 23 dB. No available pressure regulator in the prior art could be found which would operate anywhere close to this huge dynamic range.

Note that the area of the largest hole is 245 times the area of the smallest hole thereby approximating the pressure ratio discussed above. In this manner, the flow is moderated as the load is lowered, and the flow can even be considered to be nearly constant and independent of the pressure drop causing the flow.

The purpose of the present invention is to maintain an average constant flow rate under a wide range of fluid pressure in a closed system. Specifically, but not limited to, providing a constant descent rate of a hydraulic jack regardless of the load within the jack's rated capacity. This device is also a safety device that eliminates the possible operator error of opening the release valve too quickly allowing an uncontrolled rapid descent of the jack. This device is an economical inline pressure compensating flow control valve that uses a plunger, spring, and a rod with a series of ports to maintain an average flow rate under a wide range of pressures. The flow rate of hydraulic fluid is a relationship between the pressure drop of the fluid across the orifice and the orifice size through which the fluid is flowing. As the pressure drop increases with a given orifice size, the flow rate will also increase. Therefore it is possible to maintain a constant flow rate under changing pressure drops by changing the orifice size to match the given pressure. The pressure in the system is determined by the amount of weight being supported by the jack. The greater the weight being lifted, the greater the pressure of the fluid in the lifting ram chamber 5*a*.

The present invention advantageously uses a plunger that is controlled by a spring to open or close a series of orifices depending on the pressure in the system. The areas of the multiple orifices combine as a single orifice area size to determine the flow rate. As the orifices are closed off it reduces the area through which the fluid can flow thereby reducing the flow rate.

When the jack is suspending a load, it creates a pressure in the Lifting Ram Cavity 5*a*. In order to lower the weight, the Release Valve 4 is turned to open a path for the fluid to travel from the Lifting Ram Cavity 5*a* to the Tank Cavity 6*a*. The greater the weight being suspended, the greater the pressure in the Lifting Ram Cavity 5*a*. Due to the pressure, when Release Valve 4 is opened, the fluid will then travel into Plunger Cavity 17. The fluid will then travel around the Plunger 9 toward the Ports 12-15. The higher the pressure the faster the fluid will flow. The faster the fluid flows the more it forces the Plunger 9 up compressing Spring 8. Spring 8 is sized according to the desired flow rate. As Plunger 9 travels up it closes off ports to reduce the amount of fluid than can pass onto Tank Cavity 6*a*. When Plunger 9 has closed off enough ports to establish equilibrium with the bias of Spring 8, the fluid can then flow freely through the remaining ports. Once the weight is no longer adding pressure to the system, then Plunger 9 will travel downward opening more ports to allow the fluid to flow to Tank Cavity 6*a* at the same rate under lower pressure.

Prior art pressure compensating flow regulators use a needle valve that is manipulated by the use of a spring and a pressure bypass. As the pressure in the fluid increases the valve closes to allow less fluid to pass through. The downside of these existing devices is that they only work over a narrow pressure range.

Previous hydraulic jacks control the descent rate by manually controlling the opening of the release valve by unscrewing the valve. The problem with this is that this system relies on the operator to be careful when opening the valve not to open it too far and allow the weight to be dropped at an unsafe rate. The present invention serves to eliminate this problem. No matter how fast or far the operator opens the valve it will only descend at a safe rate no matter how much weight is being lowered.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydraulic jack, comprising:

a load cylinder;

a pump configured to provide pressurized fluid to said load cylinder;

a release valve in fluid communication with the pressurized fluid; and a flow regulator configured to alter a flow path of the fluid therethrough as an inverse function of a pressure drop of the fluid across said flow regulator, said flow regulator being in fluid communication with said release valve, said flow regulator includes a plurality of ports, a select number of said plurality of ports having the fluid pass therethrough dependent upon the pressure drop.

2. The hydraulic jack of claim 1, wherein said select number is lower when the pressure drop is higher.

3. The hydraulic jack of claim 2, wherein said plurality of ports have more than one opening size.

4. The hydraulic jack of claim 2, wherein a balance of said plurality of ports equaling a total number of said plurality of ports minus said select number of said plurality of ports are substantially isolated from the pressurized fluid.

5. The hydraulic jack of claim 2, wherein said flow regulator further includes a sliding device configured to uncover said select number of said ports dependent upon the pressure drop.

6. The hydraulic jack of claim 5, wherein said sliding device is a sleeve.

7. The hydraulic jack of claim 6, wherein said flow regulator further includes a biasing member acting on said sleeve, said biasing member being more compressed when the pressure drop is higher and less compressed as the pressure drop lessens.

8. A hydraulic system to provide for a release of pressurized fluid, comprising:

a release valve in fluid communication with the pressurized fluid; and a flow regulator configured to alter a flow path of the fluid therethrough as an inverse function of a pressure drop of the fluid across said flow regulator, said flow regulator being in fluid communication with said release valve, said flow regulator includes a plurality of ports, a select number of said plurality of ports having the fluid pass therethrough dependent upon the pressure drop.

9. The hydraulic system of claim 8, wherein said select number is lower when the pressure drop is higher.

10. The hydraulic system of claim 9, wherein said plurality of ports have more than one opening size.

11. The hydraulic system of claim 9, wherein a balance of said plurality of ports equaling a total number of said plurality of ports minus said select number of said plurality of ports are substantially isolated from the pressurized fluid.

12. The hydraulic system of claim 9, wherein said flow regulator further includes a sliding device configured to uncover said select number of said ports dependent upon the pressure drop.

13. The hydraulic system of claim 12, wherein said sliding device is a sleeve.

14. The hydraulic system of claim 13, wherein said flow regulator further includes a biasing member acting on said sleeve, said biasing member being more compressed when the pressure drop is higher and less compressed as the pressure drop lessens.

15. A method of retracting a hydraulic cylinder under a load, the method comprising the steps of:

releasing a valve in fluid communication with pressurized fluid in the cylinder; and altering a flow path of the fluid through a flow regulator as a pressure drop of the fluid across said flow regulator changes, said flow regulator being in fluid communication with said valve said flow regulator includes a plurality of ports, a select number of said plurality of ports having the fluid pass therethrough dependent upon the pressure drop.

16. The method of claim 15, wherein said select number is lower when the pressure drop is higher.

17. The method of claim 15, wherein said plurality of ports have more than one opening size.

18. The method of claim 15, wherein a balance of said plurality of ports equaling a total number of said plurality of ports minus said select number of said plurality of ports are substantially isolated from the pressurized fluid.

* * * * *